US005216856A

United States Patent [19]

Schroeder

[11] Patent Number: 5,216,856

[45] Date of Patent: Jun. 8, 1993

[54] DOOR FRAME FASTENED TO AN EXISTING OPENING

[75] Inventor: Kevin Schroeder, Warren, N.J.

[73] Assignee: Schroeder Bros. Co., Inc., Warren, N.J.

[21] Appl. No.: 633,466

[22] Filed: Dec. 24, 1990

[51] Int. Cl.[5] ..... E06B 1/04

[52] U.S. Cl. ..... 52/210; 52/213; 49/504

[58] Field of Search ..... 52/213, 204, 210, 211, 52/217, 127.7, 127.9, 239, 240, 241; 49/504, 505

[56] References Cited

U.S. PATENT DOCUMENTS 3,570,202 3/1971 Castellano ..... 52/211

3,808,759 5/1974 Carmichael ..... 49/505 X

FOREIGN PATENT DOCUMENTS 3441192 7/1986 Fed. Rep. of Germany ..... 52/213

*Primary Examiner*—Richard E. Chilcot, Jr.
*Assistant Examiner*—Lan M. Mai
*Attorney, Agent, or Firm*—Horst M. Kasper

[57] ABSTRACT

A door frame is prefabricated at remote construction sites and is installed into wall openings without requiring substantial on-site fittings, moldings, trims, and attachments. The door frame includes a header jamb and header grooves. A header scribe strip is fitted to and disposed in one of the header grooves. Header spring means are disposed in said header groove and are pressing the header scribe strip outwardly. Header plate means are pivotally attached to the side of the frame facing the opening face of the wall opening and disposed such as to assume a first locking position. A first and a second side jamb each have a first end attached to the header jamb and have a first and a second side groove. A first side scribe strip and a second side scribe strip are in each case fitted to and disposed in one of the respective side grooves. First and second side spring means are disposed in each case in the respective side grooves and press the respective side scribe strip outwardly. First and second side plate means are pivotally attached to the respective side of the frame and disposed such as to assume a respective locking position. The respective side scribe strip is retained in the respective side groove such that the protruding side of the respective side scribe strip is about flush with the corresponding side of the frame.

10 Claims, 5 Drawing Sheets

DOOR FRAME FASTENED TO AN EXISTING OPENING

BACKGROUND OF THE INVENTION

1. Field of the Invention

The invention relates to a door frame to be placed into an opening furnished for holding the door frame.

2. Brief Description of the Background of the Invention Including Prior Art

Conventionally, prehung doors have been employed to simplify construction of buildings with respect to closable passageways. However, the attachment and fitting and matching of such prehung doors into openings requires in general substantial work with respect to alignment, fitting, and attachment. In particular, the prehung door has to be measured and cut such that it can be matched to and precisely fitted into an existing opening.

A. B. Carper, in the U.S. Pat. No. 2,481,721, teaches a door frame for incorporation into a building structure to receive a door, a window, or a similar closure. The reference teaches to employ screws 6 and springs 12 to secure the head jamb. The screws 6 are passing through the jamb and into the studding. Substantial work is required to properly fit and attach such frame.

The U.S. Pat. No. 2,853,161 to E. P. Mascari teaches adjustable frames. The reference teaches to position ratchet guide members within guideways formed between pawl or tongue members and an elongated jamb, while the elongated jamb will be guided in the guideway formed between the ratchet guide members and cooperating portions of the end face and of the strip face. It appears from the drawings that substantial work is required in installing the frames into an opening.

The U.S. Pat. No. 3,795,076, to Richard N. Anderson, teaches a window structure. In the assembly of the sash guide and the tilt release structure 90 of the Richard W. Anderson teaching, the pivot portion 134 of the tilt release member 120 is placed in a pivot notch 132, and one end of the biasing spring 122 is positioned in the recess 152, with the other end of the spring 122 being positioned in a guide therefor in the sash guide member 118. The reference teaches to employ springs in connection with the construction of windows, but the installation requirements remain substantially complicated.

SUMMARY OF THE INVENTION

1. Purposes of the Invention

It is an object of the present invention to allow for production of a door frame at remote construction sites where the frames will fit precisely into wall openings.

It is another object of the present invention to furnish door frames which can be installed into wall openings without requiring substantial on-site fittings, moldings, trims, and attachments.

It is yet a further object of the present invention to provide door frames which show flush surfaces without visible screw and other attachment means, and which can be easily fitted into preset, prespecified openings.

These and other objects and advantages of the present invention will become evident from the description which follows.

2. Brief Description of the Invention

The present invention provides for a prefabricated door frame for a wall opening. A header jamb, having a first and a second end, has a first header groove disposed parallel to the longitudinal extension of the header jamb and running near a front side of the header jamb on the side of the frame facing the opening face of the wall opening. The header jamb has a second header groove disposed parallel to the longitudinal extension of the header jamb and running near a front side of the header jamb on the side of the frame facing the opening face of the wall opening. A header scribe strip is fitted to one of the header grooves and is disposed in said one header groove. Header spring means are disposed in said one header groove and press the header scribe strip outwardly. Header plate means are pivotably attached to the side of the frame facing the opening face of the wall opening and disposed such as to assume a first locking position. The header scribe strip is retained in the said one header groove such that the protruding side of the header scribe strip is about flush with the corresponding side of the frame. A first side jamb has a first end attached to the first end of the header jamb. The first side jamb has a primary first side groove disposed parallel to the longitudinal extension of the first side jamb and running near a front side of the first side jamb on the side of the frame facing the opening face of the wall opening. The first side jamb has a second primary side groove disposed parallel to the longitudinal extension of the first side jamb and running near a front side of the first side jamb on the side of the frame facing the opening face of the wall opening. A first side scribe strip is fitted to one of the primary side grooves and is disposed in said one primary side groove. First side spring means are disposed in said one primary side groove and press the second scribe strip outwardly. First side plate means are pivotably attached to the first side of the frame facing the opening face of the wall opening and disposed such as to assume a first locking position. The first side scribe strip is retained in said primary side groove such that the protruding side of the first side scribe strip is about flush with the corresponding side of the frame. A second side jamb has a first end attached to the second end of the header jamb. The second side jamb has a secondary first side groove disposed parallel to the longitudinal extension of the second side jamb and running near a front side of the second side jamb on the side of the frame facing the opening face of the wall opening. The second side jamb has a second secondary side groove disposed parallel to the longitudinal extension of the second side jamb and running near a front side of the second side jamb on the side of the frame facing the opening face of the wall opening. A second side scribe strip is fitted to one of the primary side grooves and is disposed in said one primary side groove. Second side spring means are disposed in said one secondary side groove and press the second side scribe strip outwardly. Second side plate means are pivotably attached to the second side of the frame facing the opening face of the wall opening and disposed such as to assume a first locking position. The second side scribe strip is retained in said one secondary side groove such that the protruding side of the second side scribe strip is about flush with the corresponding side of the frame.

A second header scribe strip, a second primary side scribe strip, and a second secondary side scribe strip can be furnished parallel to the first header scribe strip, the first primary side scribe strip, and the first secondary side scribe strip, respectively, for fitting into a corresponding groove. The scribe strips can be furnished with a bevel on an outer side for allowing the respective plate means to turn and to engage and to change the position of the respective scribe strip from a flush position to a protruding position.

The first side jamb and the second side jamb can be disposed perpendicular to the header jamb.

One of the plate means can be furnished by a metal plate. One of the plate means can be held by a wood screw in the frame. One of the plate means can be furnished by a square aluminum plate. At least two plate means can be furnished on each side of the frame with groove and scribe strip units.

One of the spring means can be furnished by a compression spring disposed in a mortise hole.

The spring means on each side of the frame can be furnished by at least two springs for providing a substantial uniform spring force to the respective scribe strip over the length of the scribe strip.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
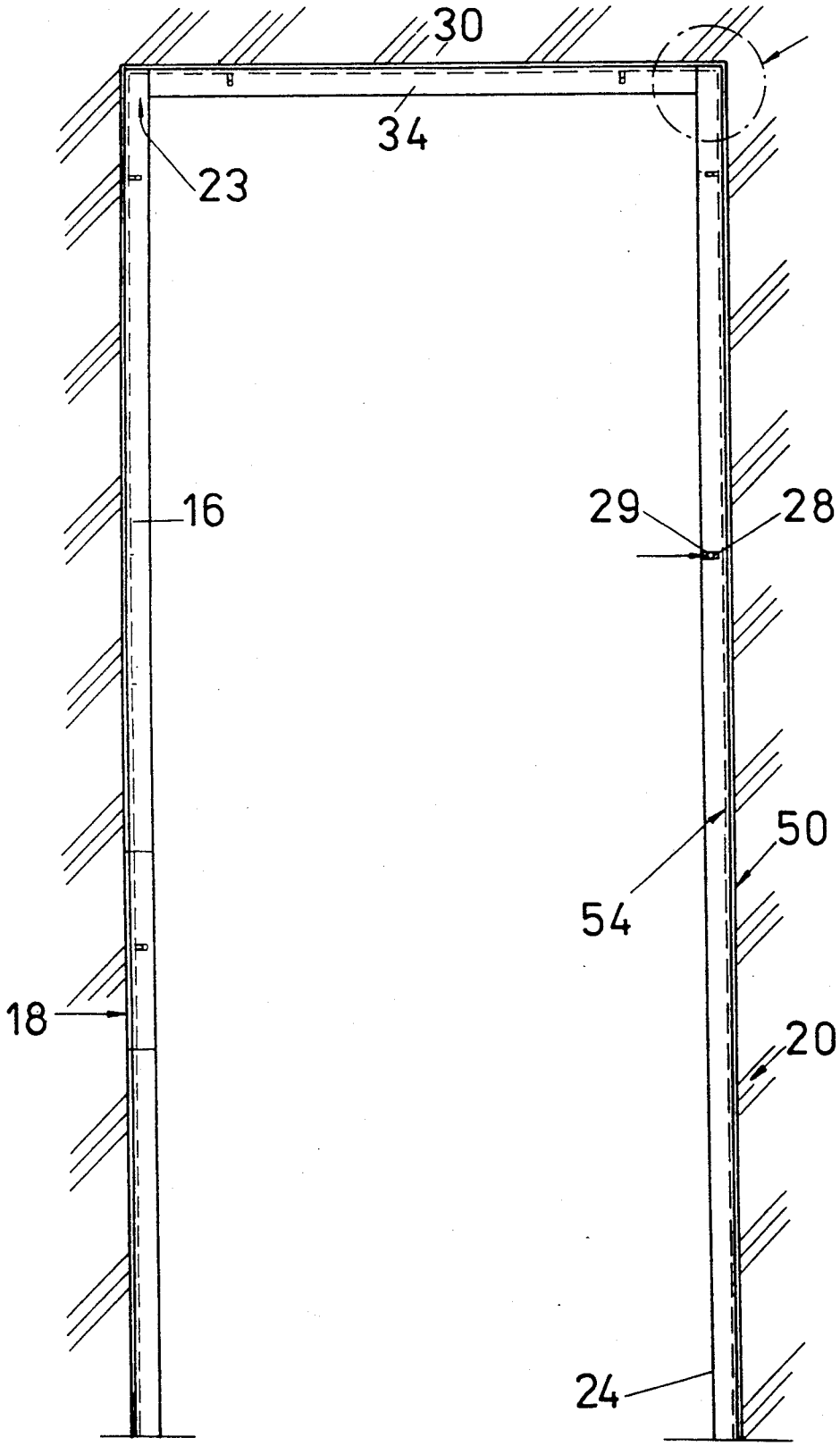
FIG. 1 shows an in part cross-sectional view of a door frame installed in a wall substrate.

FIG. 1 illustrates an overall view of the positioning of a door frame 16 into a wall opening 18. The wall opening 18 is defined by a sidewall opening 20 and a header opening 30. A door jamb 23 with a side jamb 24 and a header jamb 34 is placed into this opening 18. An arrow 54 indicates the side position of the side jamb 24 of the door.

Springs 28 are positioned in mortise holes 29. The mortise holes 29 are disposed in the side jamb 24 or, respectively, in the header jamb 34. The mortise holes 29 are disposed centered along a groove 58 (FIG. 5) in the door frame 16 for a scribe strip 22. The springs 28 are disposed such in the mortise holes 29 that they will push in a direction outwardly from the door frame 16 toward the adjoining opening faces 50 of the sidewall opening 20. The direction of the mortise holes 29 and of the springs 28 is in general perpendicular to the jamb 23, wherein the mortise holes 29 and the springs 28 are located.

Figure 2:
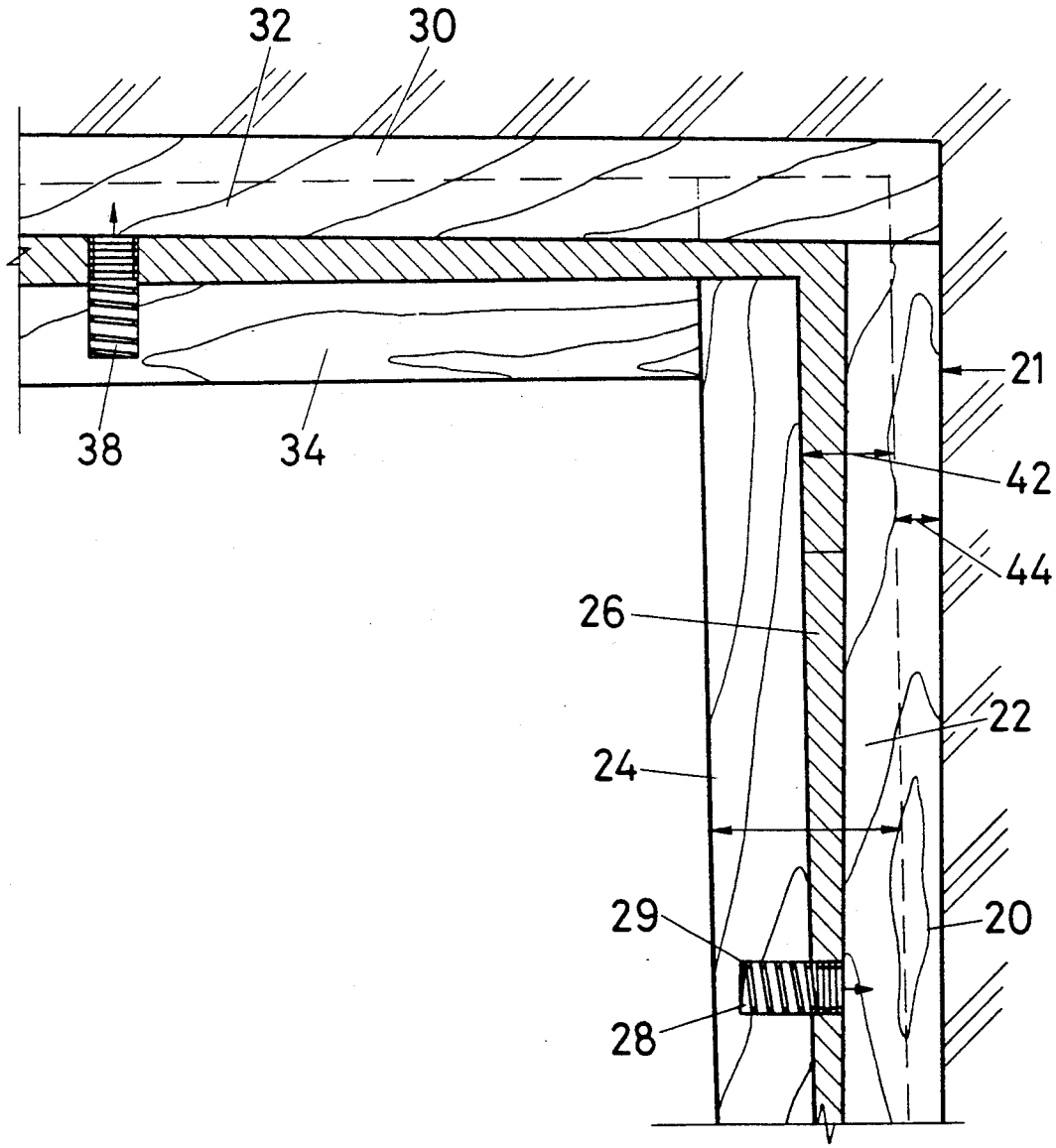
FIG. 2 shows a vertical sectional view of a detail of the embodiment of FIG. 1, illustrating an upper corner of a door frame placed into a wall opening.

FIG. 2 illustrates a detail of the upper right corner of the door jamb mounting and assembly illustrated in FIG. 1.

The present frame system is constructed to fit into precise openings of a wall of a building. The opening can be defined, for example, by a frame, formed by side jambs 24 and a header jamb 34, illustrated in FIG. 2. A scribe strip 22, 32 is adjoining the door opening and resting in a respective groove 58 of the door frame 16. The groove 58 is generally disposed parallel to the longitudinal direction of the jambs 23 and is disposed in the side of the jamb facing immediately the opening faces 50 of the sidewall opening 20. As seen in FIG. 2, the scribe strip 22, 32 is contacting the sidewall opening 20 in the installed door position. Between the door frame 16 and the scribe strip 22 there is disposed a gap 26. The spring 28 is pressing the scribe strip 22 against the sidewall opening 20. The same relationship as shown for the side jamb 24 holds for the head jamb 34. In this case, a spring 38 presses a header scribe strip 32 against the header opening 30. If the scribe strip 22, 32 is moved inwardly and submerges deeper into the respective groove 58 of the door frame 16, the position of the scribe strip 22, 32 is indicated in FIG. 2 by the arrows 42. The area, covered by the outer edge 122 of the scribe strip 22, 32 during its motion, is defined for the sidewall opening 20 by the double arrow 44. The springs 28 and 38 press the side scribe strip 22 and, respectively, the header scribe strip 32 against the sidewall opening 20 and, respectively, against the header opening 30. A tight positioning of the scribe strips 22, 32 assures that the door frame 24, including the side jamb 24 and the header jamb 34, are maintained in a solid position.

Figure 3:
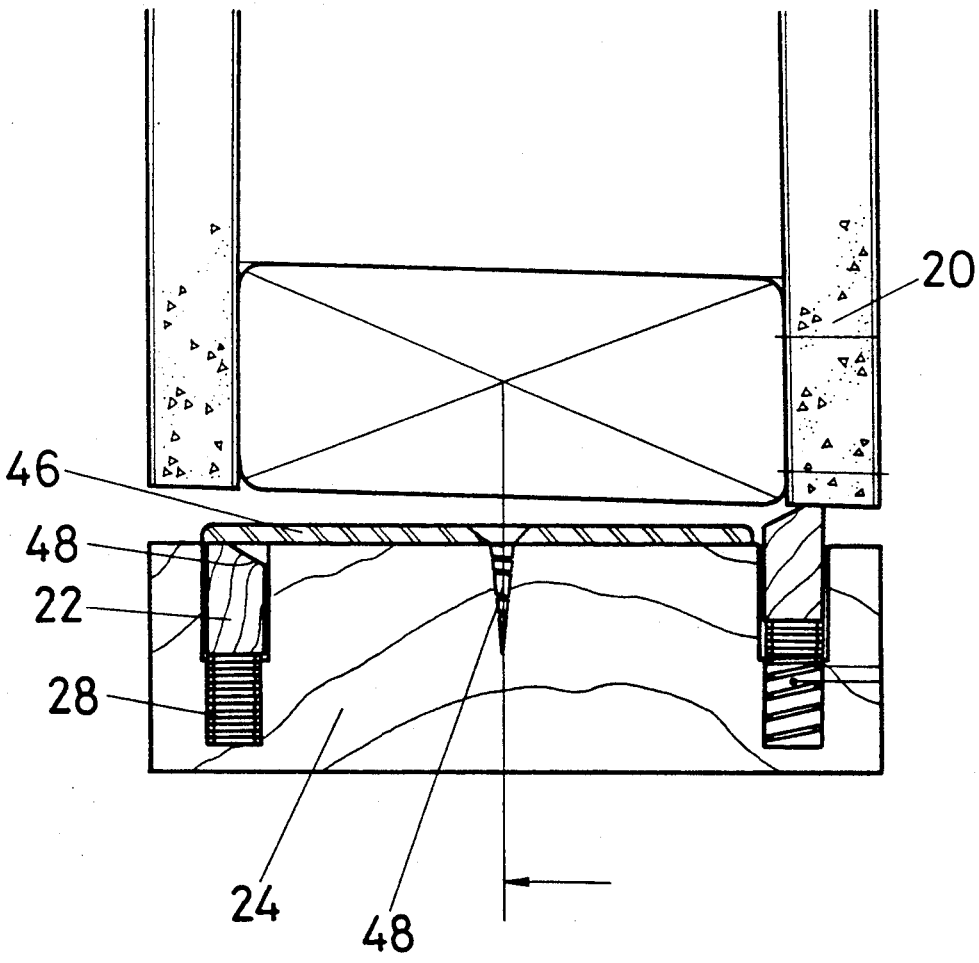
FIG. 3 shows a sectional view, illustrating a locking position and a released position of an installed sliding plate.

FIG. 3 illustrates a system for maintaining the scribe strips 22, 32 in position. The left-hand side of FIG. 3 illustrates how the locking plate 46 engages and locks the scribe strip 22, 32. The scribe strip 22, 32 is of a trapezoidal shape, where the outer side of the scribe strip 22, 32 is bevelled at an angle of from about 30 to 60 degrees, and preferably at an angle of from about 45 to 55 degrees relative to the direction of the spring action. The bevelled edge 120 can assume from about $\frac{1}{3}$ to $\frac{2}{3}$ of the thickness of the scribe strip 22, 32. The scribe strip 22, 32 is preferably of an elongated cross-section, where the width can be from about 1.2 to 5 times the thickness, and where the width is preferably from about 1.5 to 2.5 times the thickness of the scribe strip 22, 32. The bevel 120 is disposed on the side of the scribe strip 22, 32 neighboring the location of the locking plate 46. The locking plate 46 is retained in position by a screw 48, which is preferably a flat-head screw, screwed into the side jamb 24 at a position not visible after proper installation of the door frame 16.

The right-hand side of FIG. 3 illustrates the removal of the locking plate 46 from a locking position relative to the scribe strip 22. In this case, the spring 28 presses the scribe strip 22 against the sidewall opening 20. It can be seen on FIG. 3 that as long as the sidewall opening 20 is furnished with a straight edge, and as long as the scribe strip 22 is also furnished with an outer straight edge, an exact matching between the outer side edge of the scribe strip 22 and of the sidewall opening 20 can be achieved, thereby eliminating any opening between the door jamb 24 and the sidewall opening section 20. The position of the scribe strip 22, with respect to the front and the rear side of the frame in a direction of passage through the door, can be from about 0.5 to 3, and is preferably from about 1.7 to 1.5, times the thickness of the scribe strip 22. The length of the compression spring 28, 38 in its restrained position can be from about 0.5 to 1, and is preferably from about 0.6 to 0.9, times the width of the scribe strip 22, as measured in the direction of motion of the scribe strip 22.

Figure 4:
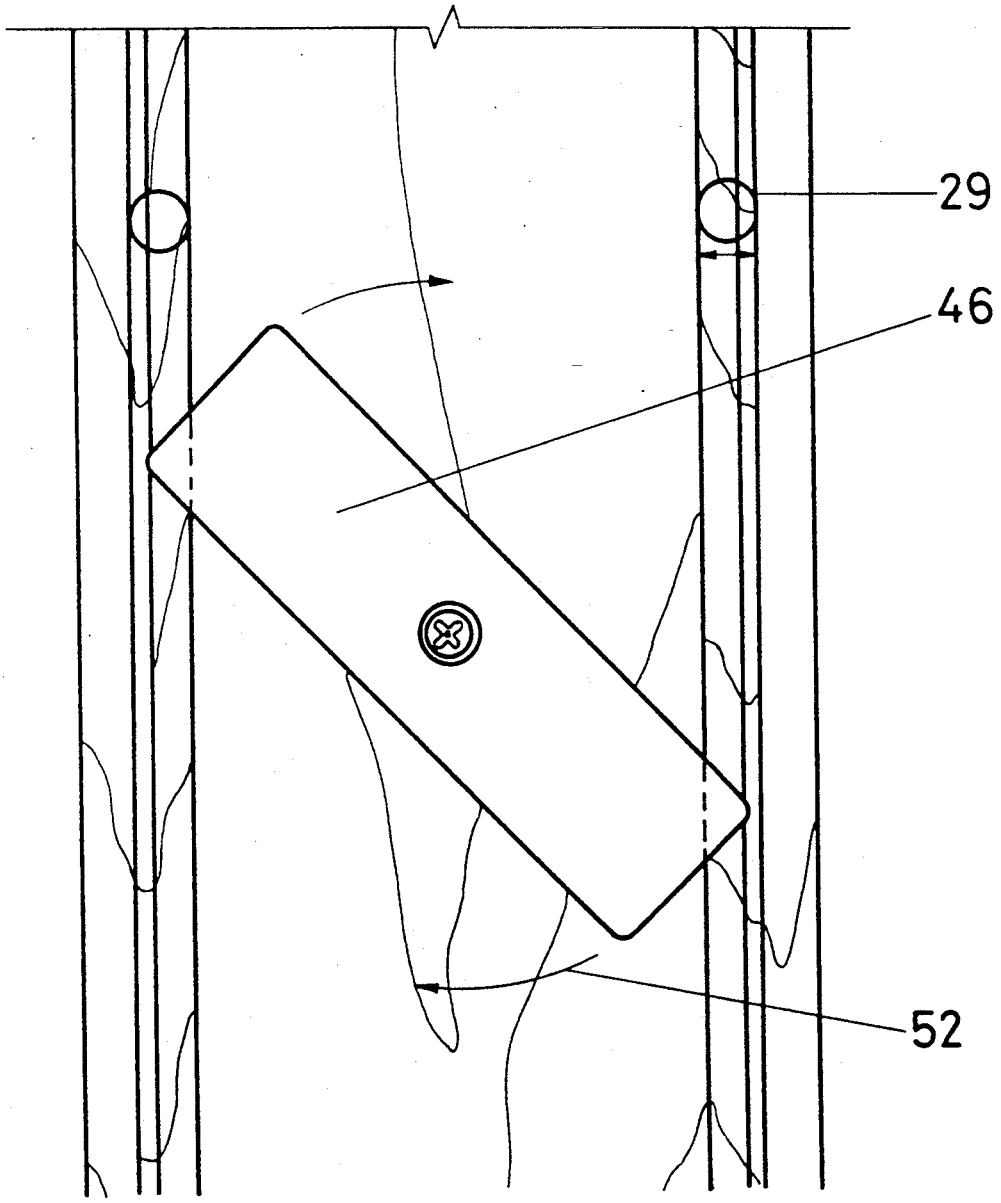
FIG. 4 shows a side elevational view of an uninstalled door frame illustrating the locking plate disposed in a locking position.
Figure 5:
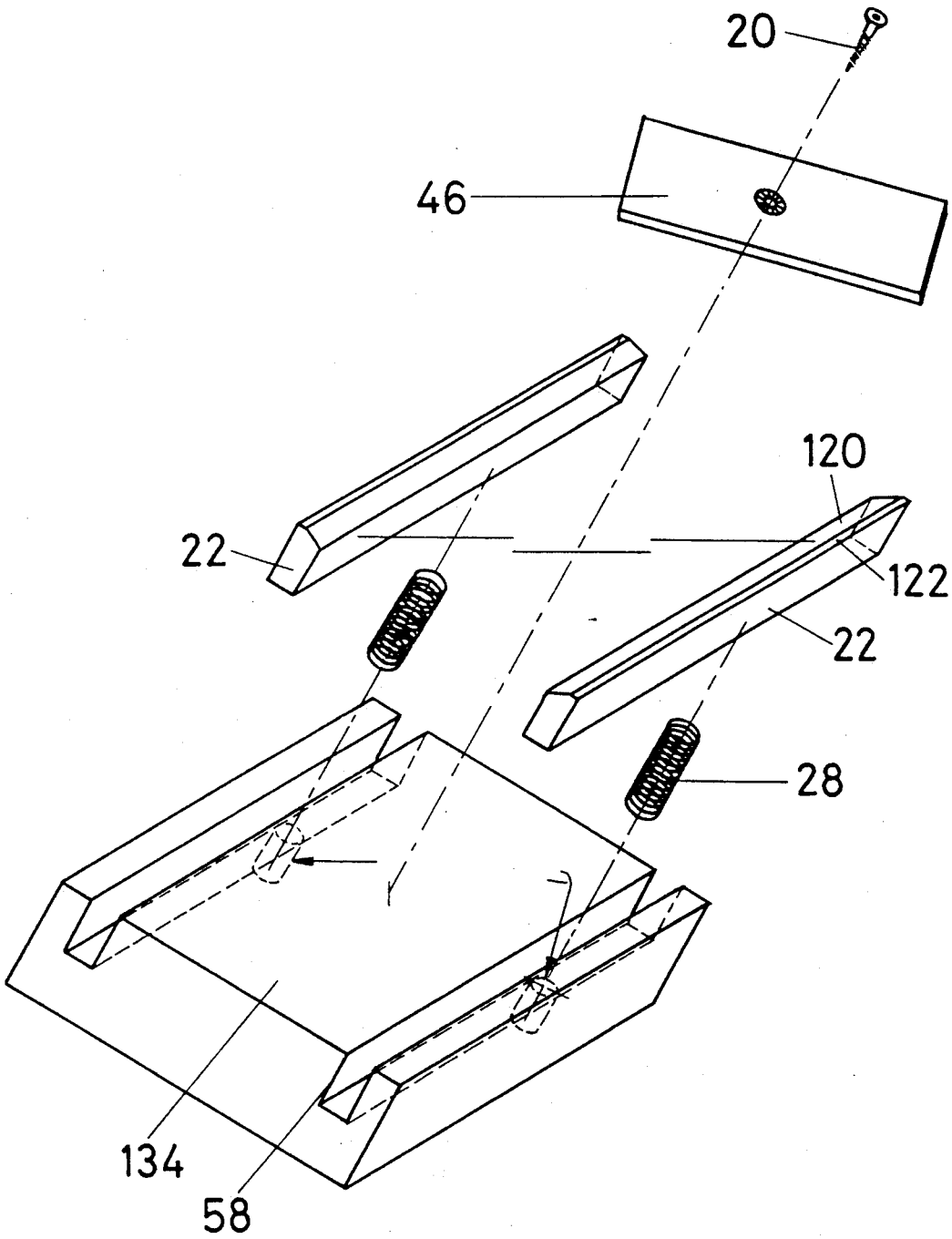
FIG. 5 shows an exploded view of a door jamb assembly, partially in section, together with a locking mechanism.

FIG. 4 illustrates a side elevational view of the section illustrated in FIG. 4, with the locking plate 46 in position, locking the bevelled surface of the scribe strip 22 flush with the frame surface 134 (FIG. 5). The arrow 52 illustrates the motion of the locking plate 46 for releasing the spring-driven scribe strip 22, 32. The position of the spring 28 in the mortise hole 29 for the scribe strip 22 is illustrated in a planar view near the top of FIG. 4, where it is recognized that the mortise hole axis falls into the symmetry plane of the groove 58. The angle over which the locking plate 46 can move is preferably limited such that excessive motion is prevented.

FIG. 5 illustrates an exploded view of the door jamb assembly. It can be seen that cutout grooves 58 are furnished for guiding and maintaining the scribe strips 22, 32 in retaining position. The scribe strips 22, 32 preferably make a flush fit when inserted into the cutout grooves 58. The attachment of the locking plate 46 preferably occurs at the center of the locking plate 46 and at a position of the surface of the jamb 23 corresponding to a middle line between the grooves 58. The locking plate 46 is preferably placed attached at the center of the outside of the respective side jamb 24 or header jamb 34. The cutout grooves 58 are preferably disposed symmetrically relative to the outside of the jamb 24, 34. A symmetrical position of the cutout grooves 58 and a center position of the locking plate 46 will assure that the scribe strips 22, 32 are simultaneously engaged and disengaged upon a turning of the locking plate 46. The depth of the cutout grooves 58 can be from about 0.3 to 0.7, and preferably from about 0.4 to 0.6, times the thickness of the door jamb 34. The thickness of the scribe strips 22, 32 can be from about 1/20 to 1/10 of the width of the jamb 24, 34.

The mode of operation of the system is as follows. The door frame 16 is preassembled. The springs 28, 48 are placed into the mortise holes 29. Then, the scribe strips 22, 32 are inserted on top of the springs 28, 48, and the springs 28, 48 are pressed together. The scribe strips 22, 32 are placed flush with respect to the outside surface of the door jamb 24, 34, and the locking plate 46 is placed on top of the scribe strips 22, 32, such that these remain in position.

The frame assembled in this manner at the factory is then brought by transporting means to the location of installation. At the location of installation, the door frame 16 is placed into a preexisting door opening, which opening nearly matches the outer dimensions of the frame. The door frame is placed in position inside the door opening. Once the door frame is in position, a screwdriver or similar flat tool is employed to move the locking plate 46 in the direction of the arrow 52. Once the locking plates 46 are moved in this direction, the scribe strips 22, 32 are pressed by the springs 28 to shoot out and to contact the opening 50 for the door. In this way, a flush contact is furnished between the opening 50 and the frame 16. This procedure is performed for the two side jambs 24 and for the header jamb 34. The action of the spring 28, 48 together with the friction, experienced by the scribe strips 22, 32 in the cutout grooves 58, takes care that the door is maintained in a stable position. Preferably, the strength of the springs 28, 48 is the same for all the mortise holes 29, thereby approximately the same force is exerted on all sides onto the scribe strips 22, 32. In this manner, the door frame is in an elastic and stable position. It is also possible to remove the door frame from the opening. For this purpose, a knife or similar tool is employed to retract the scribe strips 22, 32 from the locking position in the wall opening. Then the knife can be employed to turn the locking plate 46 to retain a respective scribe strip 22, 32 into a retracted position. After this has been done for the side scribe strips 22 and for the header scribe strips 32, the door can be removed from the wall opening. This allows an easy exchange of door frames in cases where a damage of the door frame has occurred and replacement by a like door frame.

The invention structure allows that the frame surface is uniform and not hurt or defaced by any attachment means required to attach the frames to the wall opening. For example, a surface of the door frame can be natural wood, can be fabric, or any other means. Similar, the wall opening and its surroundings can also be surfaced. This surface of the surrounding wall opening will not be damaged by the door frame installation according to the invention.

It will be understood that each of the elements described above, or two or more together, may also find a useful application in other types of construction frame installations differing from the types described above.

While the invention has been illustrated and described as embodied in the context of a door frame fastened to an existing door opening, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A prefabricated door frame for a wall opening comprising a header jamb having a first end and having a second end, having a front side and having a back side and having a first header groove disposed parallel to a longitudinal extension of the header jamb and running near the front side of the header jamb on a side of the frame facing the opening face of the wall opening defining a boundary of the wall opening, and having a second header groove disposed parallel to the longitudinal extension of the header jamb and running near the front side of the header jamb on the side of the frame facing the opening face of the wall opening;

a first header scribe strip fitted to one of the header grooves and disposed in said one header groove;

header spring means disposed in said one header groove and pressing the header scribe strip outwardly;

header plate means pivotably attached to the side of the frame facing the opening face of the wall opening and disposed such as to assume a first locking position, where the header scribe strip is retained in the said one header groove such that the protruding side of the header scribe strip is about flush with the corresponding side of the frame;

a first side jamb having a first end attached to the first end of the header jamb and having a primary first side groove disposed parallel to a longitudinal extension of the first side jamb and running near a front side of the first side jamb on the side of the frame facing the opening face of the wall opening, and having a second primary side groove disposed parallel to the longitudinal extension of the first side jamb and running near a front side of the first side jamb on the side of the frame facing the opening face of the wall opening, wherein the first side jamb defines a first side of an opening;

a first side scribe strip fitted to one of the primary side grooves and disposed in said one primary side groove; first side spring means disposed in said one primary side groove and pressing the second scribe strip outwardly; first side plate means pivotably attached to the first side of the frame facing the opening face of the wall opening and disposed such as to assume a first locking position, where the first side scribe strip is retained in said primary side groove such that a protruding side of the first side scribe strip is about flush with a corresponding side of the frame;

a second side jamb having a first end attached to the second end of the header jamb, and having a secondary first side groove disposed parallel to a longitudinal extension of the second side jamb and running near a front side of the second side jamb on the side of the frame facing the opening face of the wall opening, and having a second secondary side groove disposed parallel to the longitudinal extension of the second side jamb and running near a front side of the second side jamb on the side of the frame facing the opening face of the wall opening, wherein the second side jamb defines a second side of an opening;

a second side scribe strip fitted to one of the primary side grooves and disposed in said one primary side groove;

second side spring means disposed in said one secondary side groove and pressing the second side scribe strip outwardly;

second side plate means pivotably attached to the second side of the frame facing the opening face of the wall opening and disposed such as to assume a first locking position, where the second side scribe strip is retained in said one secondary side groove such that a protruding side of the second side scribe strip is about flush with a corresponding side of the frame.

2. The prefabricated door frame according to claim 1, wherein a second header scribe strip, a second primary side scribe strip, and a second secondary side scribe strip are furnished parallel to the first header scribe strip, the first primary side scribe strip, and the first secondary side scribe strip, respectively, for fitting into a corresponding groove.

3. The prefabricated door frame according to claim 1, wherein the scribe strips are furnished with a bevel on an outer side for allowing the respective plate means to turn and to engage and to change the position of the respective scribe strip from a flush position to a protruding position.

4. The prefabricated door frame according to claim 1, wherein the first side jamb and the second side jamb are disposed perpendicular to the header jamb.

5. The prefabricated door frame according to claim 1, wherein one of the spring means is furnished by a compression spring disposed in a mortise hole.

6. The prefabricated door frame according to claim 1, wherein one of the plate means is furnished by a metal plate.

7. The prefabricated door frame according to claim 1, wherein one of the plate means is held by a wood screw in the frame.

8. The prefabricated door frame according to claim 1, wherein one of the plate means is furnished by a square aluminum plate.

9. The prefabricated door frame according to claim 1, wherein at least two plate means are furnished on each side of the frame with groove and scribe strip units.

10. The prefabricated door frame according to claim 1, wherein the spring means on each side of the frame is furnished by at least two springs for providing a substantial uniform spring force to the respective scribe strip over all lengths of the scribe strips.

* * * * *